US010323911B1

(12) United States Patent
Krauss et al.

(10) Patent No.: US 10,323,911 B1
(45) Date of Patent: Jun. 18, 2019

(54) DEVICE FOR NON-LETHAL STOPPAGE OF WATER JET PROPELLED CRAFT

(71) Applicants: Andrew Krauss, Concord, MA (US); Steve Brandis, Virginia Beach, VA (US); Damien Bretall, Baltimore, MD (US); Ryan Faber, Virgina Beach, VA (US); Alma Jacobson, Virginia Beach, VA (US); Chelsea Shores, Virginia Beach, VA (US)

(72) Inventors: Andrew Krauss, Concord, MA (US); Steve Brandis, Virginia Beach, VA (US); Damien Bretall, Baltimore, MD (US); Ryan Faber, Virgina Beach, VA (US); Alma Jacobson, Virginia Beach, VA (US); Chelsea Shores, Virginia Beach, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 102 days.

(21) Appl. No.: 15/252,290

(22) Filed: Aug. 31, 2016

(51) Int. Cl.
*F41H 11/08* (2006.01)
*B63B 38/00* (2006.01)
(Continued)

(52) U.S. Cl.
CPC ..... *F41H 11/08* (2013.01); *B63B 38/00* (2013.01); *F41H 11/05* (2013.01); *F41H 13/0006* (2013.01)

(58) Field of Classification Search
CPC ..... F41H 11/08; F41H 11/05; F41H 13/0006; B63B 38/00
See application file for complete search history.

(56) References Cited

U.S. PATENT DOCUMENTS 4,441,453 A * 4/1984 McMickle ..... A01K 61/70 119/221
6,045,423 A * 4/2000 Silvia ..... B63B 35/78 441/130

(Continued)

FOREIGN PATENT DOCUMENTS

DE 2851552 A1 * 6/1980 ..... F41H 11/05
JP 2000292095 A * 10/2000 ..... F41H 11/05

OTHER PUBLICATIONS

Machine translation of DE 2851552 A1 to Petters, European Patent Office.*

(Continued)

*Primary Examiner* — Joshua T Semick
(74) *Attorney, Agent, or Firm* — Dawn C. Russell

(57) ABSTRACT

The disclosed invention is a device for non-lethally stopping or slowing any water jet propelled craft, such as a common personal watercraft (PWC), by disrupting the water suction and thereby reducing the generated thrust. Most PWCs have an inboard engine that is coupled to a water jet pump which uses an impeller to generate thrust. This invention is ingested by the PWC intake to either clog the intake gate (or screen) or fill critical volume in any portion of the jet pump (such as the intake, impeller, stator, or pressure nozzle). In any case, water flow through the jet drive is significantly reduced which reduces the vessel's thrust. PWCs depend on adequate water flow through the jet pump to generate the thrust required for propulsion and steerage, and to provide engine cooling. Since this invention is designed to interrupt water flow, the result is reduced speed, steerage, and/or engine overheating.

17 Claims, 1 Drawing Sheet

(51) Int. Cl.
*F41H 11/05* (2006.01)
*F41H 13/00* (2006.01)

(56) References Cited

U.S. PATENT DOCUMENTS

| | | | | |
|---|---|---|---|---|
| 6,060,153 | A * | 5/2000 | McNeil | B32B 5/24 119/207 |
| 6,343,567 | B1 * | 2/2002 | McNeil | A01K 61/70 119/256 |
| 8,245,617 | B2 * | 8/2012 | Martinez | B63G 9/04 114/382 |
| 8,256,336 | B2 * | 9/2012 | Larkin | B63G 8/001 114/316 |
| 8,402,894 | B1 * | 3/2013 | McGuigan | F42B 12/68 102/374 |
| 8,601,928 | B2 * | 12/2013 | Martinez | B63G 9/04 114/317 |
| 2007/0062638 | A1 * | 3/2007 | Carroll | A41D 13/0125 156/290 |

OTHER PUBLICATIONS

Machine translation of JP-2000292095 to Hosoya, European Patent Office.*
SCOPE Buoys Help Track Oil, Apr. 23, 2016, Smithsonian Ocean Portal, ocean.si.edu.*

* cited by examiner

DEVICE FOR NON-LETHAL STOPPAGE OF WATER JET PROPELLED CRAFT

STATEMENT OF GOVERNMENT INTEREST

The invention described herein may be manufactured and used by, or for the Government of the United States of America, for governmental purposes without payment of any royalties thereon or therefore.

BACKGROUND

Personal water crafts (PWCs) are a common type of water jet propelled craft that are fast, compact and highly maneuverable. As such, they are used for a variety of purposes including recreation and waterway travel. Unfortunately, PWCs are also, sometimes, used for illicit activities such as drug running or terrorism (suicide bombing etc.). In these cases, enforcement entities (law enforcement, armed forces, etc.) may want to slow down or stop the PWC and its operator to keep waterways safe. Water jets are commonly referred to as pump jets or hydrojets, which create a jet of water to generate thrust for propulsion and steerage.

Current methods of stopping or slowing a PWC include fire arms or artillery to disable the craft and/or its operator, or employing a device such as a net to physically trap or restrain the PWC and its operator. While these and similar methods may be effective, they are often undesirable because they can have serious residual or unintended consequences. The use of fire arms or artillery can be lethal to the operator and cause irreparable damage to the PWC. In situations where the PWC operator's intentions are unclear, it is ill-advised or legally impermissible for law enforcement to use lethal force unless or until the operator's intentions are determined to be hostile. Until such time, enforcement officers want to take precautionary measures to slow or temporarily disable the PWC and its operator.

Nets can be used to physically trap and restrain PWCs. However, the net needs to be large, strong, and heavy enough to disable a PWC traveling at high speed. Also, an extremely powerful device would be required to launch the net with enough force to stop the PWC at a distance that reduces or eliminates the PWC's threat to a potential target. This is very difficult, especially when the PWC is attempting evasive maneuvers. A sufficiently sized launcher may be physically unmanageable on smaller water vessels and may be very expensive. Additionally, a net can get entangled with the PWC's impeller causing irreparable vessel damage. Deployed nets need to be recovered from the water to prevent entanglement with other vessels or marine life, and net recovery requires a significant amount of time, equipment, and expense.

Other mechanisms can target the propulsion system, but they would rely on entanglement in the PWC's propulsion system. While effective in stopping the PWC, entanglement may cause undesirable, permanent damage to the engine of the PWC. Consequently, what is needed is a non-lethal method for stopping PWCs that does not damage the craft or cause significant injury to the operator.

SUMMARY

Disclosed is a device for non-lethal stoppage of a water jet propelled craft. The device comprises a head section and multiple tentacle-like tail sections attached to an end of the head section and extending out from the head section in a streaming fashion.

The head section is assembled to provide a biodegradable, malleable, and slightly negatively buoyant system. Dense, weighted material can be comprised of granular material such as sand or other environmentally suitable material that provides a dense weight to the head section. This dense material provides enough mass to launch the system over long distances. A positively buoyant material, such as water-soluble foam, may be used to ensure that the net buoyancy of the head section is only slightly negative.

In an exemplary embodiment of the current invention, the granular material is encased in a packet at the front end of the head section to concentrate weight forward in the device to maximize launch distance and facilitate negative buoyancy. The floating material, counteracted by the weighted packet, makes the head section negatively buoyant, while allowing the tail sections to be positively buoyant. That is, when the device is deployed in the water, the head section is suspended below the surface, while the tail sections float on the surface, extending in various directions to be ingested by the propulsion system of the PWC. Overall, the device is positively buoyant so it will remain on the water's surface. However, the device can be designed so that it absorbs water, or that the positively buoyant materials degrade faster than the negatively buoyant materials so that the device becomes more negatively buoyant over time. This will prevent the device from floating indefinitely and interfering with non-targeted vessels.

In another exemplary embodiment of the invention, the multiple tail sections are flat, approximately 2-3 inches in width, and approximately 3 feet long. To provide better stopping capability and to prevent the PWC from ejecting them, the tail sections are made of a hydrophilic material that absorbs water, becomes tacky, and sticks to portions of the PWC's propulsion system.

DRAWINGS

DETAILED DESCRIPTION

Figure 1:
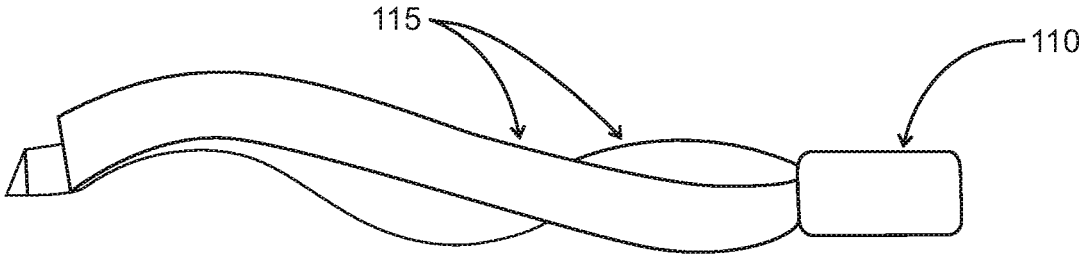
FIG. 1 is a dimensional drawing of the device.

Referring to FIG. 1, the PWC stopping device of the current invention is shown comprising a head section (110) and multiple tail sections (115). The head section (110) of the device is constructed with sufficient mass to be launched a considerable distance (several hundred feet), yet sized to pass through PWC intake grates. In this exemplary embodiment, the head section (110) is an oblong spherical shape of approximately 2-3 inches in diameter. In other embodiments the head section (110) can be designed in a variety of larger or smaller sizes and shapes that can pass through the intake grate of the propulsion systems of various water jet propelled crafts. Also, the head section (110) is malleable so that it can squeeze through the intake grate openings, as well as conform to the inside ducting of the PWC without causing damage to the PWC.

The tail sections (115) are attached to the head section (110), stream behind the head section like tentacles, and spread out in multiple directions when deployed in the water. The tail sections (115) can vary in thickness, width and length. In the exemplary embodiment of FIG. 1, the tail sections (115) are approximately two inches wide, three feet long, and a quarter of an inch thick. However, in alternate embodiments these dimensions may vary significantly to facilitate passage through PWC intake systems of various sizes. The streaming tail sections (115) are constructed of a flexible fabric-like material, which allow them to be ingested by the PWC intake. Multiple tail sections (115) increase the probability of ingestion by the PWC intake. FIG. 1 shows an embodiment with two tail sections (115). In the alternate embodiment of FIG. 2, multiple, smaller tail sections are shown. The more tail sections the device employs, the greater the probability that one of those tail sections, along with the rest of the device, gets sucked into the intake of the PWC.

The tail sections (115) may be attached to the head section (110) in numerous ways. For instance, the tail sections (115) can be sewn, fused, or glued directly to the head section (115). Alternatively, both the head section (110) and tail sections (115) can be designed from one piece of fabric. In addition, the tail sections (115) can be attached to the head section (110) via a separate piece of fabric or other viable material, as shown in FIG. 2.

Figure 2:
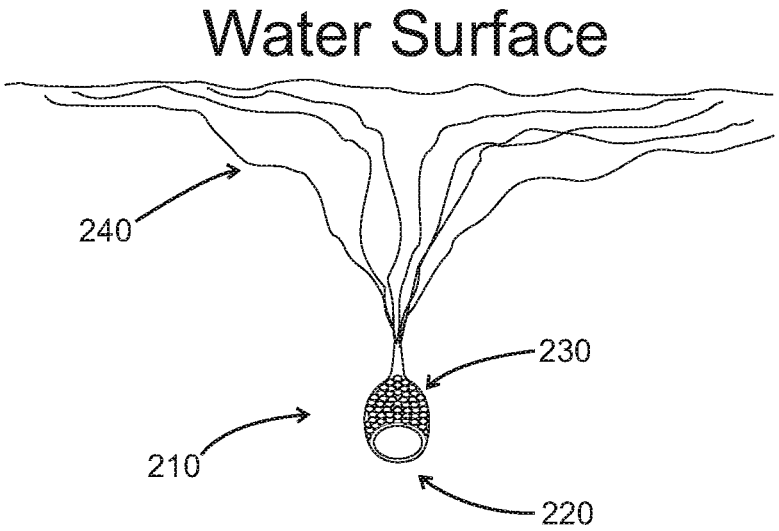
FIG. 2 is a schematic drawing of the device deployed in the water.

FIG. 2 is a schematic representation of an embodiment of the PWC stopping device deployed in water. Here, the head section (210) is shown in more detail. In this embodiment, the head section (210) is more spherical in shape. The front part of the head section (210) includes a sack of granular material (220) that provides weight to the front end of the device and allows the device to be launched hundreds of feet through the air. The sack of the granular material (220) also contributes to the head section's negative buoyance by offsetting the lightweight flotation material (230) encased in the rest of the head section. In this embodiment of the head section, the granular material (220) is separated (in a sack) from the flotation materials (230). However, in alternate embodiments, both materials can be interspersed, or a single material can be used to accomplish the same function.

The granular material (220) may be any material such as sand, or the like, that provides the requisite launching weight for the stopping device, while allowing the device to remain malleable enough to squeeze through the PWC intake grate and fill a critical volume of any portion of the jet pump to slow down or stop the PWC. The remaining space in the head section (210) is filled with a water soluble floating material (230). This floating material (230) can be biodegradable water soluble foam (230) as shown in the exemplary embodiment of FIG. 2, or some other type of floating material. The foam material (230), along with the weight from the sand packet (220), gives the head portion (210) of the device negative buoyancy while allowing the overall device to be positively buoyant. When deployed, the device orients in the water with the head portion (210) suspended below the surface of the water and the tail portions (240) floating on the surface and spreading in different directions like tentacles. The embodiment in FIG. 2 has numerous tentacle-like tail sections (240). In this embodiment, the tail sections (240) are spunbond and made of the hydrophilic material that absorbs water and becomes tacky when wet. This tackiness increases the probability that the tail sections (240) are sucked into and stick to an inner surface of the propulsion system of the PWC. In alternate embodiments the tail sections (240) can be made of a variety of flexible, fabric-like materials that allow them to be ingested into the PWC intake.

The PWC stopping device can be launched with an implement similar to a T-shirt launcher used at sporting events. Due to their compact size, many PWC stopping devices can be launched in succession, or multiple devices can be launched at once, to increase the probability that one or more get sucked into the PWC propulsion system. The PWC stopping devices can also be launched from various platforms, including a shore-based launcher, aircraft, submarine, or surface watercraft. Alternatively, the devices can be towed behind a surface watercraft and released on command. The devices can also be passively dropped from an aircraft or attached to and released from larger projectiles.

While the PWC design allows it to be launched significant distances through the air, it can also be deployed statically on the water's surface, or launched from underwater. The device is constructed with biodegradable materials to ensure that the PWC will not require a boat-lift or diver intervention to remove the device or clean out the PWC intake. This construction of the device also reduces its environmental impacts. In alternative embodiments, non-dissolving devices could also be built into a "chain of pearls" design and permanently stationed on the water's surface as a protective barrier. In addition, the device can be scaled up to stop vessels with larger jet drive propulsion systems, which are increasingly common for vessels such as high speed passenger vehicles, ferries, or military applications.

Effects of the device are generally reversible since the device is made of malleable material that does not cause permanent damage to any part of the watercraft. Engine cooling and thrust are restored once the device has been removed from the PWC's water jets. Thus, the PWC can be stopped without causing damage and returned to service if not deemed a threat. Using this device ensures that vessel stoppage will not cause injury to the vessel operators. Thrust is reduced quickly, but deceleration rates are not so harsh that the operator is slammed into the helm of the vessel or ejected from the vessel.

Although the invention has been described in detail with particular reference to these preferred embodiments, other embodiments can achieve the same results. Variations and modifications of the present invention will be obvious to those skilled in the art and it is the intent of this application to cover, in the appended claims, all such modification and equivalents. The entire disclosure and all references, applications, patents, and publications cited above are hereby incorporated by reference.

What is claimed is:

1. A device for non-lethal stoppage of a water jet propelled craft comprising:

a head section constructed of fabric, wherein the head section comprises a volume, wherein a part of the volume is filled with a malleable, weighted material, and wherein a remaining part of the volume is filled with a malleable flotation material, and wherein a combination of the malleable weighted material and the malleable flotation material in the volume of the head section make the head section negatively buoyant; and multiple tail sections attached to the head section, and constructed from a flexible, material, wherein, the multiple tail sections are positively buoyant, and wherein the negative buoyance of the head section offsets the positive buoyance of the multiple tail sections such that portions of the multiple tail sections float at or near a surface of a body of water while the head section is suspended below the surface of the body of water so that, when the water jet propelled craft passes over the multiple tail sections, the multiple tail sections are injested by an intake system of the water jet propelled craft, and the intake system pulls the multiple tail sections and the head section into the intake system and stops propulsion of the water jet propelled craft.

2. The device of claim 1, wherein the head section is approximately 2-3 inches in diameter so that it can fit through an intake grate opening to the intake system of the water jet propelled craft.

3. The device of claim 1, wherein the multiple tail sections are a approximately 3 feet long and approximately two inches wide to maximize a probability of getting injested and pulled into the intake system of the water jet propelled craft.

4. The device of claim 1, wherein
the malleable, weighted material comprises a mass and density that allows the device to be launched out over the body of water to stop a water jet propelled craft at a safe distance.

5. The device of claim 1, wherein the malleable, weighted material is granular, and encased in a packet, separate from the malleable flotation material, inside the head section.

6. The device of claim 1, wherein the malleable, flotation material is water soluble.

7. The device of claim 1, wherein the malleable weighted material is water soluble.

8. The device of claim 1, wherein the device is constructed of biodegradable material.

9. The device of claim 1, wherein the device is constructed of a tacky material to facilitate adhesion to, and filling of a volume of the intake system of the water jet propelled craft that stops the propulsion system.

10. The device of claim 1, wherein the device is constructed with a hydrophilic material.

11. The device of claim 6, wherein the malleable, flotation water soluble material comprises dissolving foam.

12. The device of claim 1, wherein the malleable weighted material is combined with the malleable flotation material inside the head section of the device.

13. The device of claim 1, wherein the multiple tail sections are attached to the head section by sewing them to the head section.

14. The device of claim 1, wherein the multiple tail sections are attached to the head section by fusing them to the head section.

15. The device of claim 1, wherein the multiple tail sections are attached to the head section by gluing them to the head section.

16. A method for non-lethal stoppage of a water jet propelled craft comprising:
inserting a device in a path of the water jet propelled craft to be injested by an intake system of the water jet propelled craft, wherein the device comprises:
a head section constructed of fabric, wherein
the head section comprises a volume, wherein
a part of the volume is filled with a malleable, weighted material, and wherein
a remaining part of the volume is filled with a malleable flotation material, and wherein
a combination of the malleable weighted material and the malleable flotation material in the volume of the head section make the head section negatively buoyant; and
multiple tail sections attached to the head section, and constructed from a flexible material, wherein
the multiple tail sections are positively buoyant, and wherein
the negative buoyance of the head section offsets the positive buoyance of the multiple tail sections such that portions of the multiple tails section float at or near a surface of a body of water so that, when the water jet propelled craft passes over the multiple tail sections, the multiple tail sections are injested by the intake system of the water jet propelled craft and the intake system pulls the device into the intake system and stops propulsion of the water jet propelled craft.

17. The method of claim 16, wherein inserting the device in the path of the water jet propelled craft comprises any one of the following:
launching the device through air into the water so that it stops the water jet propelled craft at a safe distance;
dropping the device into the water from above the water;
launching the device from underwater;
placing the device in the water manually.

* * * * *